US009909426B2

(12) United States Patent
Szijarto et al.

(10) Patent No.: US 9,909,426 B2
(45) Date of Patent: Mar. 6, 2018

(54) BLADE FOR A TURBOMACHINE

(71) Applicant: Siemens Aktiengesellschaft, Munich (DE)

(72) Inventors: Janos Szijarto, Finspong (SE); Esa Utriainen, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 265 days.

(21) Appl. No.: 14/758,235

(22) PCT Filed: Dec. 27, 2013

(86) PCT No.: PCT/EP2013/078075
§ 371 (c)(1),
(2) Date: Jun. 28, 2015

(87) PCT Pub. No.: WO2014/108318
PCT Pub. Date: Jul. 17, 2014

(65) Prior Publication Data

US 2015/0354370 A1 Dec. 10, 2015

(30) Foreign Application Priority Data

Jan. 9, 2013 (EP) ..... 13150638

(51) Int. Cl.
*F01D 5/18* (2006.01)

(52) U.S. Cl.
CPC ..... *F01D 5/186* (2013.01); *F01D 5/188* (2013.01); *F05D 2220/30* (2013.01);
(Continued)

(58) Field of Classification Search
CPC . F01D 5/186; F01D 5/188; F01D 5/18; F01D 5/147; F05D 2220/30;
(Continued)

(56) References Cited

U.S. PATENT DOCUMENTS 6,168,381 B1 1/2001 Reddy
7,534,089 B2 * 5/2009 Liang ..... F01D 5/186 415/115
(Continued)

FOREIGN PATENT DOCUMENTS

CN 1418284 A 5/2003
CN 101769170 A 7/2010
(Continued)

*Primary Examiner* — Kenneth Bomberg
*Assistant Examiner* — Brian Delrue
(74) *Attorney, Agent, or Firm* — Beusse Wolter Sanks & Maire

(57) ABSTRACT

A blade for a turbomachine includes an airfoil portion and a root portion, the airfoil portion has an outer wall having a pressure side, suction side, leading edge and trailing edge, the outer wall extending between the leading edge and a trailing edge of the airfoil portion, a first cavity between the pressure side of the outer wall and a first inner wall, a second cavity between the suction side of the outer wall and a second inner wall. The first and second inner wall form a receiving cavity therebetween. The receiving cavity is fluidly connected to both the first and second cavity. The cooling fluid in the first and second cavity is conducted in a direction from the trailing edge to the leading edge and the cooling fluid in the receiving cavity is conducted in a direction from the leading edge to the trailing edge.

13 Claims, 3 Drawing Sheets

(52) U.S. Cl.
CPC .... *F05D 2260/20* (2013.01); *F05D 2260/201* (2013.01); *F05D 2260/202* (2013.01); *F05D 2260/203* (2013.01); *F05D 2260/204* (2013.01); *F05D 2260/22141* (2013.01)

(58) Field of Classification Search
CPC ..... F05D 2260/20; F05D 2260/201; F05D 2260/202; F05D 2260/203; F05D 2260/204; F05D 2260/22141; F05D 2240/303; F05D 2240/304; F05D 2240/305; F05D 2240/306
USPC ..... 416/97 R
See application file for complete search history.

(56) References Cited

U.S. PATENT DOCUMENTS

| | | | | |
|---|---|---|---|---|
| 7,556,476 | B1 | 7/2009 | Liang | |
| 7,568,887 | B1 | 8/2009 | Liang | |
| 7,625,180 | B1 | 12/2009 | Liang | |
| 7,704,048 | B2 * | 4/2010 | Liang | F01D 5/186 415/115 |
| 8,011,888 | B1 | 9/2011 | Liang | |
| 8,057,183 | B1 | 11/2011 | Liang | |
| 8,070,443 | B1 | 12/2011 | Liang | |
| 2003/0049127 | A1 | 3/2003 | Tiemann | |
| 2006/0222494 | A1 | 10/2006 | Liang | |
| 2008/0050241 | A1 | 2/2008 | Liang | |
| 2009/0104042 | A1 * | 4/2009 | Liang | F01D 5/186 416/97 R |
| 2009/0324423 | A1 * | 12/2009 | Liang | F01D 5/186 416/97 R |
| 2010/0104419 | A1 * | 4/2010 | Liang | F01D 5/188 415/115 |
| 2010/0166564 | A1 | 7/2010 | Benjamin et al. | |
| 2011/0236221 | A1 | 9/2011 | Campbell | |
| 2012/0014808 | A1 | 1/2012 | Lee | |

FOREIGN PATENT DOCUMENTS

| | | | |
|---|---|---|---|
| CN | 102425459 | A | 4/2012 |
| EP | 1953343 | A2 | 8/2008 |
| RU | 2267616 | C1 | 1/2006 |
| RU | 2285129 | C2 | 10/2006 |

* cited by examiner

BLADE FOR A TURBOMACHINE

CROSS REFERENCE TO RELATED APPLICATIONS

This application is the US National Stage of International Application No. PCT/EP2013/078075 filed Dec. 27, 2013, and claims the benefit thereof. The International Application claims the benefit of European Application No. EP13150638 filed Jan. 9, 2013. All of the applications are incorporated by reference herein in their entirety.

FIELD OF INVENTION

The present invention relates to a blade for a turbomachine and more particularly to an airfoil portion of the blade of the turbomachine.

BACKGROUND OF INVENTION

In modern day turbomachines various components of the turbomachine operate at very high temperatures. These components include the blade or vane component, which are in shape of an airfoil. In the present application, only "blade", but the specifications can be transferred to a vane. The high temperatures during operation of the turbomachine may damage the blade component, hence cooling of the blade component is important. Cooling of these components is generally achieved by passing a cooling fluid that may include air from a compressor of the turbomachine through a core passage way cast into the blade component.

The blade typically includes an airfoil portion and a root portion separated by a platform. The airfoil portion of the blade is cooled by directing a cooling fluid to flow through radial passages formed in the airfoil portion of the blades. Typically, a number of small axial passages are formed inside the blade airfoils that connect with one or more of the radial passages so that cooling air is directed over the surfaces of the airfoils, such as the leading and trailing edges or the suction and pressure surfaces. After the cooling air exits the blade it enters and mixes with the hot gas flowing through the turbine section.

Typically, cooling of the blade is achieved by supplying the cooling fluid from the compressor to the cooling channels in the blades. The cooling channels often include multiple flow paths that are designed to maintain all aspects of the turbine blade at a relatively uniform temperature.

Several different cooling arrangements based on a combination of convective, impingement, and external film-based cooling have been proposed in the state of the art.

Some of the existing designs of the blade require too much amount of cooling fluid to pass through the channels and cavities therein, to provide a desired cooling to the blade.

SUMMARY OF INVENTION

It is therefore an object of the present invention to provide an improved and efficient cooling arrangement for the blade and additionally efficiently utilizing the cooling fluid to cool the blade.

This object is achieved by providing a blade for a turbomachine according to the claims.

According to aspects of the invention, a blade for a turbomachine is provided. The blade includes an airfoil portion and a root portion, the airfoil portion comprising an outer wall having a pressure side, a suction side, a leading edge and a trailing edge, the outer wall extending between the leading edge and a trailing edge of the airfoil portion, a first cavity between the pressure side and a first inner wall and a second cavity between the suction side and a second inner wall, wherein the first inner wall and the second inner wall form a receiving cavity therebetween, wherein the receiving cavity is fluidly connected to both the first cavity and the second cavity, wherein the cooling fluid in the first cavity and the second cavity is conducted in a direction from the trailing edge to the leading edge and wherein the cooling fluid in the receiving cavity is conducted in a direction from the leading edge to the trailing edge.

By directing the cooling fluid into the first cavity and the second cavity, the cooling fluid is conducted in a direction from the trailing edge to leading edge in the first cavity and the second cavity cooling the hot outer wall of the blade. Furthermore, fluid is directed into the receiving cavity from the first cavity and the second cavity and thereafter to the trailing edge cavity to provide cooling. Such an arrangement enables efficient utilization of cooling fluid to cool the blade.

In one embodiment, a cooling fluid is directed into the first cavity and the second cavity of the airfoil portion through the root portion of the blade. Such an arrangement enables cooling fluid to be present at the root portion or at a cooling fluid source located outside the blade. Furthermore, during operation fluid is directed to the airfoil portion from the root portion due to the centrifugal force.

In one embodiment, the blade includes a trailing region, a leading region and a core region. The three regions may be either cooled dependently or independently through an intricate maze of cooling channels and/or cavities.

In one embodiment, the first cavity, the second cavity and the receiving cavity are located at the core region to enable enhanced cooling of the core region of the blade.

In another embodiment, the leading region includes a leading edge cavity and the trailing region includes a trailing edge cavity for enabling cooling of the trailing region and leading region respectively.

In one embodiment, the trailing edge cavity is fluidly connected to the receiving cavity through a plurality of channels. Such an arrangement enables cooling fluid in the receiving cavity to be directed to the trailing edge cavity and subsequently let out from an opening in the trailing edge into the hot gas path.

As already mentioned, the cooling fluid in the first cavity and the second cavity is conducted in a direction from trailing edge to leading edge. This enables cooling of the pressure side wall and the suction side wall and thereafter the inner walls and internal structures in the blade. By having such an arrangement an efficient utilization of the cooling fluid and enhanced cooling is achieved.

In one embodiment, the outer wall forms a spanning portion from the pressure side to the suction side, the spanning portion prevents the cooling fluid in the first cavity and the second cavity to enter the leading edge cavity. Furthermore, the spanning portion changes the flow direction of cooling fluid by directing the cooling fluid into the receiving cavity.

In another embodiment, the first inner wall and the second inner wall are spaced from the spanning portion of the outer wall to form a gap therebetween. The gap allows cooling fluid to be directed into the receiving cavity and prevents backflow into the first cavity and the second cavity.

BRIEF DESCRIPTION OF THE DRAWINGS

The above-mentioned and other features of the invention will now be addressed with reference to the accompanying drawings of the present invention. The illustrated embodiments are intended to illustrate, but not limit the invention. The drawings contain the following figures, in which like numbers refer to like parts, throughout the description and drawings.

DETAILED DESCRIPTION OF INVENTION

Embodiments of the present invention described below relate to a blade component in a turbomachine. However, the details of the embodiments described in the following can be transferred to a vane component without modifications, that is the terms "blade" or "vane" can be used in conjunction, since they both have the shape of an airfoil. The turbomachine may include a gas turbine, a steam turbine, a turbofan and the like.

Figure 1:
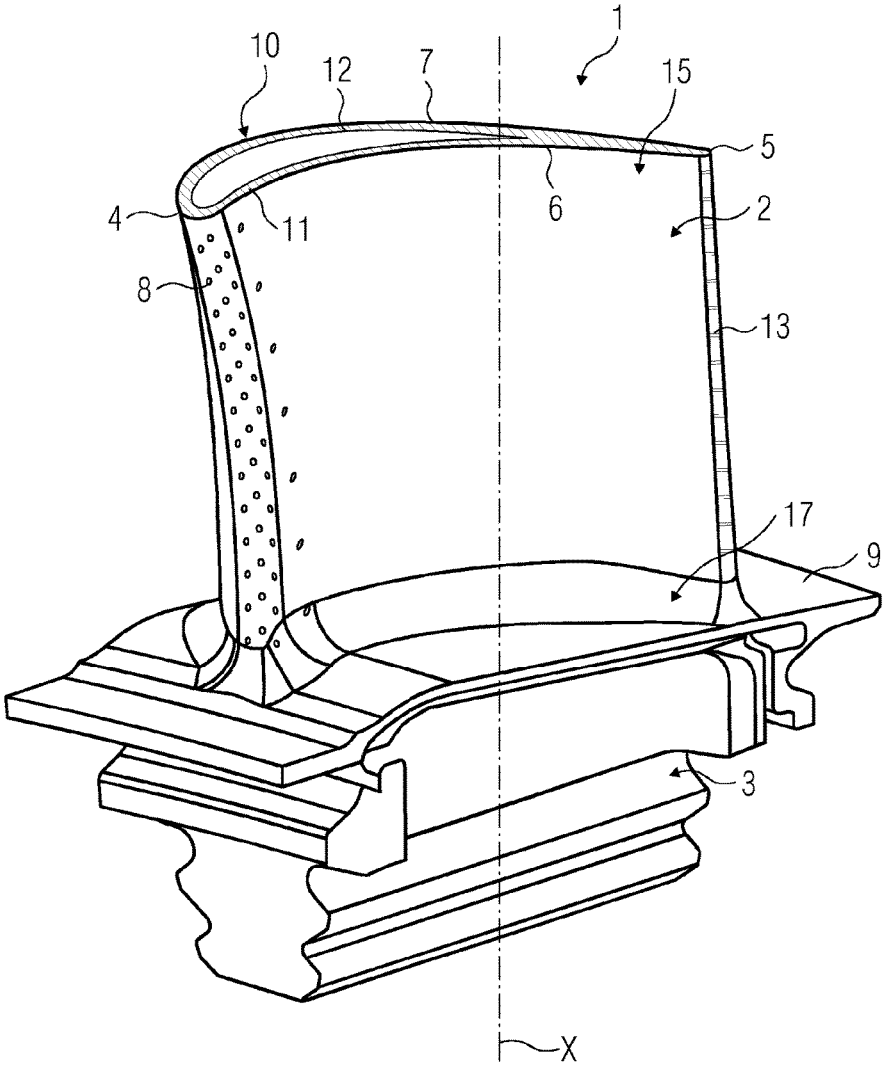
FIG. 1 is a schematic diagram of a blade of a turbomachine.

FIG. 1 is a schematic diagram of an exemplary blade 1 of a rotor (not shown) of a turbomachine, such as a gas turbine. The blade 1 includes an airfoil portion 2 and a root portion 3. The airfoil portion 2 projects from the root portion 3 in a radial direction X as depicted, wherein the radial direction X means a direction perpendicular to the rotation axis of the rotor. Thus, the airfoil portion 2 extends radially along a longitudinal direction of the blade 1. The blade 1 is attached to a body of the rotor (not shown), in such a way that the root portion 3 is attached to the body of the rotor whereas the airfoil portion 2 is located at a radially outermost position. The airfoil portion 2 has an outer wall 10 including a pressure side 6, also called pressure surface, and a suction side 7, also called suction surface. The pressure side 6 and the suction side 7 are joined together along an upstream leading edge 4 and a downstream trailing edge 5, wherein the leading edge 4 and the trailing edge 5 are spaced axially from each other as depicted in FIG. 1.

The outer wall portion on the pressure side may be referred to as the pressure-side wall 11 and the outer wall portion on the suction side may be referred to as the suction-side wall 12. The suction-side and the pressure-side walls 11, 12 collectively delimit an internal region of the airfoil 2, which is thus, demarcated from an external region located outside the airfoil 2. The respective surfaces of the walls 11, 12 facing the internal region are referred to as inner surfaces. Similarly, the respective surfaces of the walls 11, 12 facing the external region are referred to as outer surfaces.

In accordance with the aspects of the present technique, one or more cooling holes 8 are present on the pressure side 6 and the suction side 7 of the blade as depicted in FIG. 1. The cooling holes 8 aid in film cooling of the blade 1.

A platform 9 is formed at an upper portion of the root portion 3. The airfoil portion 2 is connected to the platform 9 and extends in the radial direction X outward from the platform 9.

In accordance with aspects of the present technique, the airfoil portion 2 of the blade 1 typically includes a cooling arrangement, which includes an intricate maze of internal structures such as cooling passages having cavities, channels and other structures such as ribs and pin fins for enabling enhanced cooling.

Typically, the blade 1 may have three regions, namely a leading region, a trailing region and a core region between the leading region and the trailing region. Hence, the cavities present at the leading region, core region and the trailing region are referred to as the leading cavity, core cavity and the trailing cavity respectively.

It may be noted that the airfoil portion 2 of the blade has a first end 15 and a second end 17 extending in the direction X radial to the root portion 3, wherein the second end 17 is at the platform 9, adjacent to the root portion 3 and the first end 15 is distal from the platform 9 and the root portion 3. The first end 15 is also referred to as the tip of the blade 1.

Figure 2:
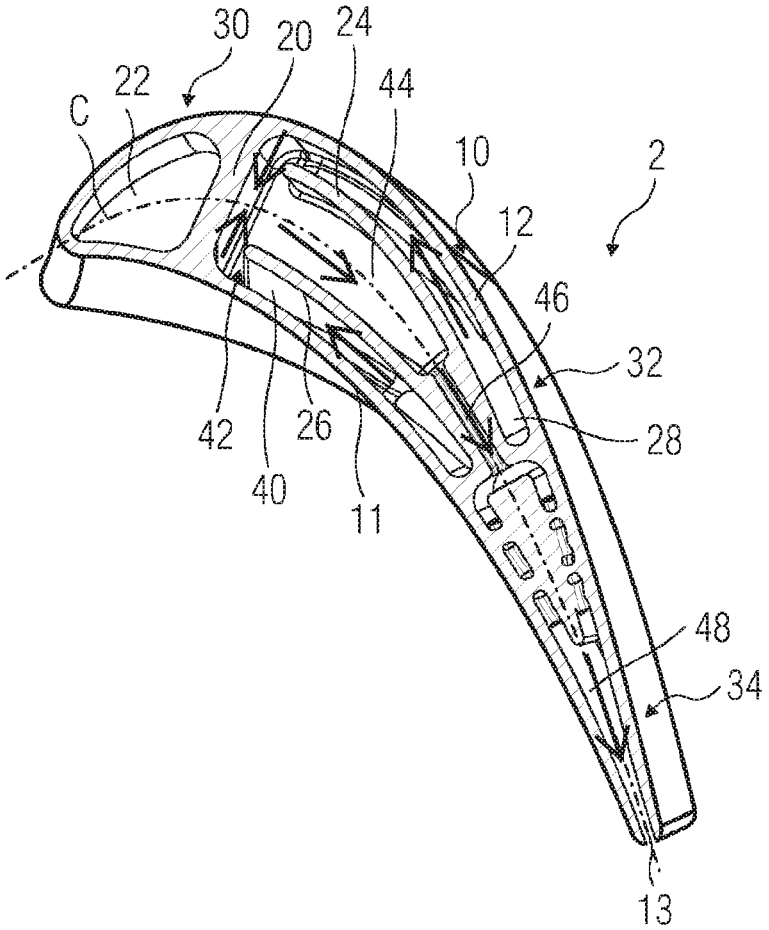
FIG. 2 is a cross-sectional view of the blade of FIG. 1.
Figure 3:
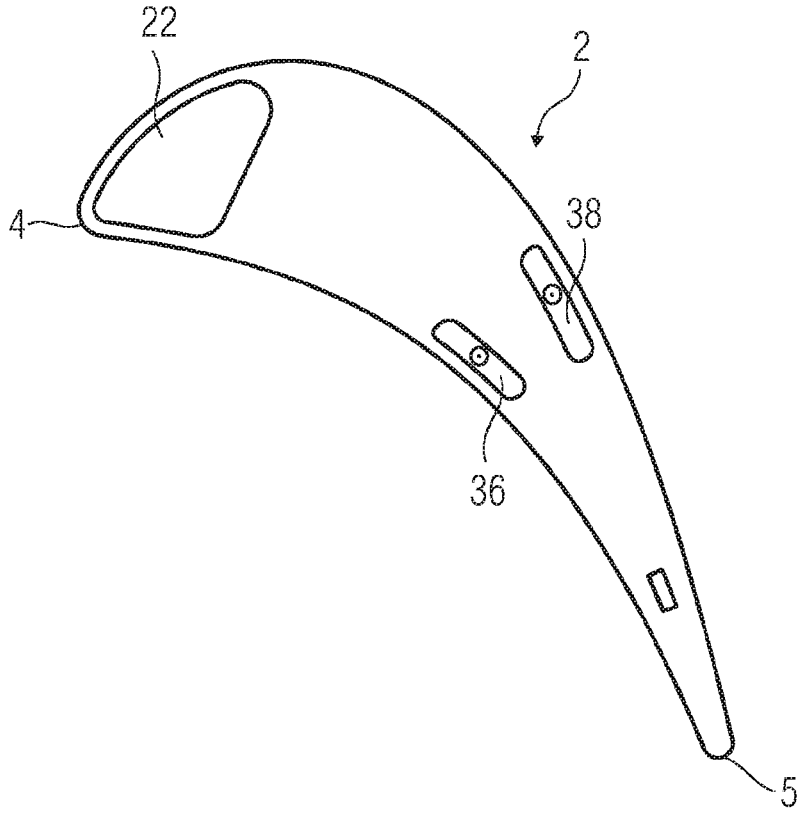
FIG. 3 is a cross-sectional view of the airfoil portion of the blade depicting the bottom view of the airfoil, in accordance with aspects of the present technique.

Referring now to FIG. 2 in combination with FIG. 3, wherein FIG. 2 depicts a cross sectional view of the blade 1 of FIG. 1. The outer wall 10 includes the leading edge 4 and the trailing edge 5, spaced apart from the leading edge 4 in a chordal direction along camber line C. Furthermore, the outer wall 10 includes the pressure side 6 and the suction side 7.

As previously noted, the airfoil portion 2 of the blade includes the leading region 30, the trailing region 34 and the core region 32 between the leading region 30 and the trailing region 34. The respective regions have different internal structures which aid in cooling the portions of the airfoil 2.

In accordance with aspects of the present technique, the blade 1 includes a first inner wall 26 and a second inner wall 24 spaced apart from the outer wall 10, more particularly, the first inner wall 26 is spaced apart from the pressure-side wall 11 and the second inner wall 24 is spaced apart from the suction-side wall 12. A first cavity 40 is formed between the first inner wall 26 and the pressure side of the outer wall and a second cavity 28 is formed between the second inner wall 24 and the suction side of the outer wall.

More particularly, the first cavity 40 is formed between the first inner wall 26 and the pressure-side wall 11 and the second cavity 28 is formed between the second inner wall 24 and the suction-side wall 12.

The first inner wall 26 is coupled to the outer wall 10 on the pressure side 6 and the second inner wall 24 is coupled to the outer wall 10 on the suction side 7. The first inner 26 wall and the second inner wall 24 are present in the core region 32 of the blade.

Furthermore, in between the first inner wall 26 and the second inner wall 24 a receiving cavity 44 is formed, which is fluidly connected to the first cavity 40 and the second cavity 28.

The outer wall 10 of the airfoil includes a spanning portion 20 that extends from the pressure side 6 to the suction side 7. The spanning portion 20 is integral to the outer wall 10 and extends within the airfoil portion 2 of the blade 1.

A leading edge cavity 22 is formed between the leading edge 4 and the spanning portion 20. Furthermore, the spanning portion 20 separates the first cavity 40, the second cavity 28 and the receiving cavity 44 from the leading edge cavity 22.

In accordance with aspects of the present technique, the first inner wall 26 and the second inner wall 24 are spaced apart from the spanning portion 20 forming a gap 42 therebetween. FIG. 3 shows a cross-sectional view of the airfoil portion 2 from the second end 17 which is attached to the platform 9, the platform 9 separating the airfoil portion 2 and the root portion 3.

The airfoil portion 2 has the second end 17 adjacent to the root portion 3 and the first end 15 radially outward from the second end 17. The second end 17 of the airfoil portion 2 includes a first inlet 36 and a second inlet 38 for directing the cooling fluid (as indicated by the arrowheads in the inlets) into the first cavity 40 and the second cavity 28 respectively.

Cooling fluid from the first cavity 40 and the second cavity 28 enters the receiving cavity 44 through the gap 42 and thereafter flows in the direction from the leading edge 4 to the trailing edge 5 as indicated by the arrows.

Additionally, the airfoil portion 2 includes a trailing edge cavity 48 located in the trailing region 34. The trailing edge cavity 48 is fluidly connected to the receiving cavity 44 through one or more channels. In the presently contemplated configuration, the trailing edge cavity 48 is fluidly connected to the receiving cavity 44 through a channel 46. Cooling fluid from the receiving cavity 44 is directed into the trailing edge cavity 48 and subsequently directed out from an opening 13 on the trailing edge 5 of the airfoil into the hot gas path.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the embodiments of the present invention as defined.

The invention claimed is:

1. A blade for a turbomachine, comprising an airfoil portion and a root portion, the airfoil portion comprising:

an outer wall having a pressure side, a suction side, a leading edge and a trailing edge, the outer wall extending between the leading edge and the trailing edge of the airfoil portion, a first cavity between the pressure side of the outer wall and a first inner wall, a second cavity between the suction side of the outer wall and a second inner wall, wherein the first inner wall and the second inner wall form a receiving cavity, wherein the first cavity and the second cavity are both disposed astride a location on a camber line of the airfoil portion, wherein the receiving cavity encompasses the location, and wherein the receiving cavity is fluidly connected to both the first cavity and the second cavity, wherein a cooling fluid in the first cavity and the second cavity is conducted in a direction from the trailing edge to the leading edge while within the first cavity and the second cavity, and wherein the cooling fluid in the receiving cavity is then conducted past the location while traveling in a direction from the leading edge to the trailing edge.

2. The blade for a turbomachine according to claim 1, wherein the cooling fluid is directed into the first cavity and the second cavity of the airfoil portion through the root portion of the blade.

3. The blade for a turbomachine according to claim 1, further comprising a leading region, a trailing region and a core region, wherein the core region is between the leading region and the trailing region.

4. The blade for a turbomachine according to claim 3, wherein the first cavity, the second cavity and the receiving cavity are located at the core region of the blade.

5. The blade for a turbomachine according to claim 3, further comprising a leading edge cavity at the leading region and a trailing edge cavity at the trailing region.

6. The blade for a turbomachine according to claim 5, wherein the trailing edge cavity is configured to receive the cooling fluid from the receiving cavity through a channel.

7. The blade for a turbomachine according to claim 1, wherein the outer wall forms a spanning portion extending from the pressure side to the suction side.

8. The blade for a turbomachine according to claim 5, wherein the spanning portion of the outer wall forms the leading edge cavity between the leading edge and the spanning portion.

9. The blade for a turbomachine according to claim 5, wherein the spanning portion of the outer wall separates the leading edge cavity from the first cavity, from the second cavity, and from the receiving cavity.

10. The blade for a turbomachine according to claim 1, wherein the first inner wall is coupled to the outer wall at the pressure side.

11. The blade for a turbomachine according to claim 1, wherein the second inner wall is coupled to the outer wall at the suction side.

12. The blade for a turbomachine according to claim 7, wherein the first inner wall and the second inner wall are spaced from the spanning portion of the outer wall to form a gap therebetween.

13. The blade for a turbomachine according to claim 1, wherein the trailing edge comprises an opening for directing the cooling fluid out of the airfoil portion.

* * * * *